US006363537B1

(12) United States Patent
Park

(10) Patent No.: US 6,363,537 B1
(45) Date of Patent: Apr. 2, 2002

(54) CAP WITH SIZE ADJUSTABLE SWEATBAND

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 0 days.

(21) Appl. No.: 09/737,561

(22) Filed: Dec. 18, 2000

(51) Int. Cl.[7] ..... A42B 1/22
(52) U.S. Cl. ..... 2/181; 2/181.2
(58) Field of Search ..... 2/181, 181.2, 195.1, 2/195.2, 175.1, 209.12

(56) References Cited

U.S. PATENT DOCUMENTS 3,513,481 A * 5/1970 Nickerson ..... 2/181
4,011,600 A 3/1977 Malk
4,274,157 A 6/1981 Boden
4,481,681 A 11/1984 Hankin
4,642,817 A 2/1987 Ferstenfeld
5,142,705 A 9/1992 Edwards
5,402,538 A 4/1995 Conrad
5,432,955 A * 7/1995 Plotka et al. ..... 2/181
5,584,076 A 12/1996 Armstrong
5,600,855 A 2/1997 Ramirez
5,608,917 A 3/1997 Landis et al.
5,956,773 A 9/1999 LaMantia

* cited by examiner

*Primary Examiner*—Bibhu Mohanty
(74) *Attorney, Agent, or Firm*—Jacobson Holman, PLLC

(57) ABSTRACT

A baseball cap includes a crown composed of a plurality of panels. The crown defines an opening. A visor is secured to a front portion of the crown. A sweatband is attached to an inner side of a lower periphery of the crown. The sweatband is extended at both ends in equal length to that of the opening of the crown to form a first extended sweatband and a second extended sweatband. A male fastening device and a female fastening device are respectively attached onto the first extended sweatband and said second extended sweatband.

21 Claims, 2 Drawing Sheets

SECTION A-A'

CAP WITH SIZE ADJUSTABLE SWEATBAND

BACKGROUND OF THE INVENTION

1. Field of the Invention

The present invention relates generally to an improved cap structure and particularly to a size adjustable sweatband attached to an inner side of a lower peripheral edge of a crown. The sweatband is extended to cover the size of a releasable adjustment device and the adjustment device is secured on the extended portion of the sweatband, thereby eliminating the need for an additional size adjustment device which is typically manufactured separately and attached to the cap. Therefore, the overall cost and time for manufacturing the size adjustment device is reduced. Further, a smoother inner peripheral edge of the crown provides a greater comfort to the wearer.

2. Description of the Related Art

Baseball caps are comprised of a crown in the main body, formed by a plurality of fabric panels, and a visor that is secured at the front edge of the crown. A size adjustment device is generally attached on the back portion of the lower periphery of the crown. A size adjustment device is generally made out of such materials as plastic, metal, iron, VELCRO™ fastener and is separately molded and sewn onto the back portion of the cap. The separately manufactured size adjustment device is inserted between the crown and the sweatband, and sewn together with the crown and the sweatband.

However, due to the necessity of separately manufacturing the size adjustment devices, additional time and cost incurred. Also, in attaching the size adjustment devices of the related art to the back portion of the crown, the size adjustment portion tends to be sewn unevenly onto the lower peripheral edge of the crown. Moreover, because the width of the size adjustment portion is often narrow, printing of a logo or symbol on the size adjustment device was often limiting. Further, since the portion where the sweatband and the size adjustable device are sewn together at the back portion of the lower periphery of the crown tends to be bulky, sewing becomes difficult and the bulky seam line creates discomfort for the wearer.

In light of the foregoing, there is a need for a cap that provides as effectively as those heretofore developed, but which can be manufactured at lower cost.

SUMMARY OF THE INVENTION

Accordingly, the present invention is directed to a cap with a size adjustable sweatband that substantially obviates one or more of the problems due to limitations and disadvantages of the related art.

It is a primary object of the present invention to eliminate the need for having to separately manufacture and attach the size adjustment device by extending the sweatband attached at the inner side of a lower periphery of the crown to cover an opening of a crown and, by attaching the size adjustment device such as VELCRO™ fastener on the extended sweatband, such that the extended sweatband together with the size adjustment device secured on the extended sweatband act as a size adjustment device.

It is another object of the present invention to reduce the discomfort from wearing a cap that has bulky seamline between the sweatband and the size adjustment device at the inner side of the crown's lower periphery and to increase the aesthetic image of the cap.

In order to achieve the foregoing objects, the present invention provides an improved cap structure including a crown composed of a plurality of panels, said crown defining an opening; a visor secured to a front portion of said crown; a sweatband attached to an inner side of a lower periphery of said crown; said sweatband being extended at both ends at a predetermined length; and releasable securing means attached onto the extended portion of said sweatband.

The present invention further provides a baseball cap, which includes a crown composed of a plurality of panels, the crown defining an opening; a visor secured to a front portion of the crown; a sweatband attached to an inner side of a lower periphery of the crown; the sweatband being extended at both ends in equal length to that of the opening of the crown to form a first extended sweatband and a second extended sweatband; and a male fastening device and a female fastening device respectively attached onto the first extended sweatband and said second extended sweatband.

DETAILED DESCRIPTION OF THE PREFERRED EMBODIMENT

Figure 1:
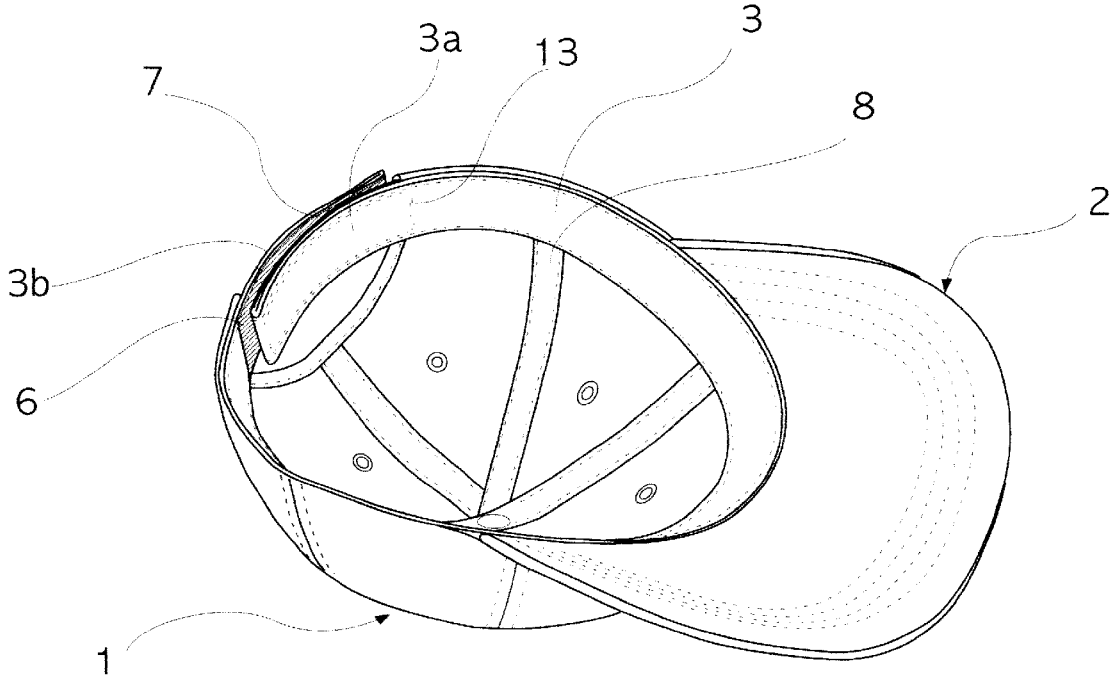
FIG. 1 is a perspective view as seen from the bottom of a typical baseball cap incorporating the size adjustable sweatband of the present invention.
Figure 2:
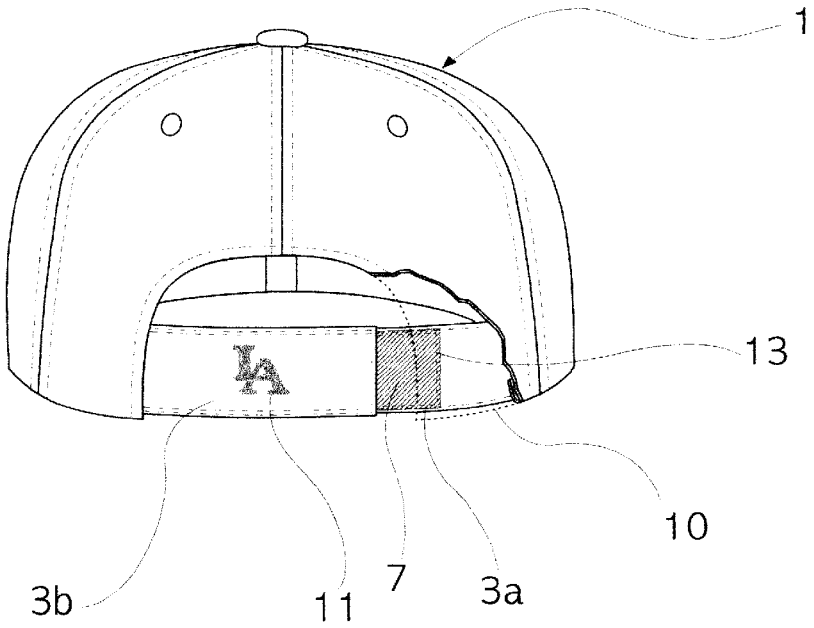
FIG. 2 is a rear view of a typical baseball cap incorporating the size adjustable sweatband of the present invention.

In accordance with the preferred embodiment of the present invention, and with particular attention directed to FIGS. 1 and 2, a cap structure having a size adjustable sweatband as illustrated in the drawings, includes a crown 1, composed of a plurality of fabric panels. The crown defines an opening on the back of the crown. The fabric panels of the crown are made out of normal woven fabric or stretchable fabric. Adjacent panels are connected and sewn together by bias tapes 8. Secured to the front portion of the crown is a visor 2, which extends away from the crown 1 at a desired angle, tilt and length. A sweatband 3 is attached to an inner side of a lower periphery of the crown 1 and is formed of a woven or non-woven fabric.

The sweatband 3, which is attached to the inner side of the lower periphery of the crown 1, is extended to the opening of the crown at both ends in equal length of that of the opening of the crown 1, thus forming a first extended sweatband 3*a* and a second extended sweatband 3*b*. A male fastening device 7 and a female fastening device 6 are respectively sewn onto the first and second extended sweatbands 3*a*, 3*b*. The first and second extended sweatbands 3*a*, 3*b* together with the male and female fastening devices 7, 6 collectively act as a size adjustment device. The male fastening device 7 and the first extended sweatband 3*a* are sewn onto a first area adjacent to a lower edge of the opening of the crown 1 along the stitch line 13. Similarly, the female fastening device 6 and the second extended sweatband 3*b* are sewn onto a second area adjacent to the lower edge of the opening of the crown 1 (not shown in the drawing). The first area is opposite to the second area from the opening of the crown 1. For illustration purpose, VELCRO™ fastener is used for the male and female fastening devices in FIG. 1

FIG. 2 shows a rear view of the preferred embodiment of the present invention. As illustrated in the drawing, the sweatband 3 is extended to the opening of the crown at both ends in equal length of that of the opening of the crown 1, thus forming the first extended sweatband 3*a* and the second extended sweatband 3*b*. The male fastening device 7 and the female fastening device 6 are respectively mounted onto the first extended sweatband 3*a* and the second extended sweatband 3*b*. The male fastening device 7 is secured onto the outer surface of the first extended sweatband 3*a*, whereas the female fastening device 6 is secured onto the inner surface of the second extended sweatband 3*b*, such that the male and female fastening devices 7, 6 face each other. When pressed together, the male and female fastening devices 7, 6 adhere to each other depending on the size of the head of the wearer.

Perforated line 10 represents a portion of the crown 1 that has been removed for better illustration of the drawing. On the outer surface of the second extended sweatband 3*b*, it is possible to print or attach a company logo or symbol 11 of a desired size.

Figure 3:
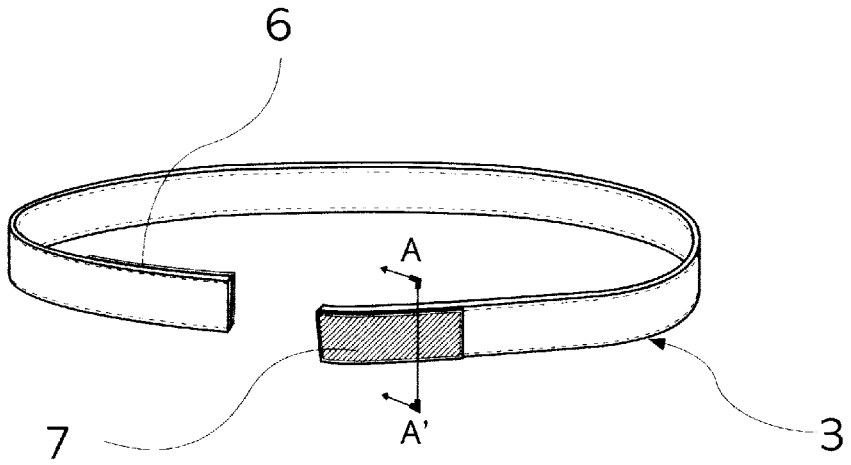
FIG. 3 is a perspective view of the sweatband of the present invention.

FIG. 3 is an illustration of the sweatband 3. As illustrated in the drawing, the sweatband 3 is made of a woven or non-woven fabric and is attached to the lower inside periphery of the crown 1 to absorb the perspiration of the wearer. The male and female fastening devices 7, 6 having a predetermined length and a width equal to the width of the sweatband 3 are attached at both ends of the sweatband 3.

Figure 4:
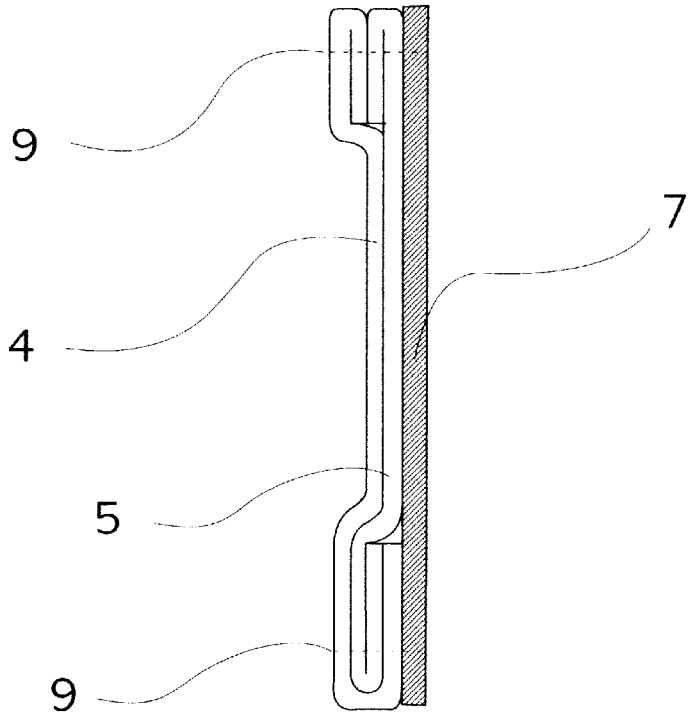
FIG. 4 is an enlarged cross-sectional view taken on line A–A' of FIG.3.

FIG. 4 is an enlarged cross-sectional view taken on line A'A' of FIG. 3. As illustrated in the drawing, the sweatband 3 consists of outer fabric 4 and inner fabric 5. The male fastening device 7 is attached to the inner fabric 5. The sweatband 3 and the male fastening device 7 are sewn together at the top and bottom periphery of the sweatband 3 along a stitch line 9.

Manufacturing caps according to the present invention not only saves time and expenses associated with producing a separate size adjustment device but it also allows a marketer to print or attach a company logo or symbol of a desired size on the outer surface of the extended sweatband to increase the aesthetic image of the cap. Also, since the inner surface of the lower periphery of the crown portion remains smooth, it provides comfort to the wearer.

It will be apparent to those skilled in the art that various modifications and variations can be made in the cap of the present invention. Thus, it is intended that the present invention cover the modifications and variations of this invention provided they come within the scope of the appended claims and their equivalents.

What is claimed is:

1. A cap, comprising:

a crown composed of a plurality of panels, said crown defining an opening on a back portion of said crown;

a visor secured to a front portion of said crown;

a sweatband attached to an inner side of a lower periphery of said crown;

said sweatband being extended at both ends at a predetermined length into the opening; and releasable securing means attached onto extended portions of said sweatband.

2. The cap as claimed in claim 1, wherein said sweatband is made out of woven fabric material.

3. The cap as claimed in claim 1, wherein said sweatband is made out of non-woven fabric material.

4. The cap as claimed in claim 1, wherein said sweatband is extended in equal length to that of the opening of the crown.

5. The cap as claimed in claim 1, wherein said sweatband is extended at both ends to form a first extended portion and a second extended portion.

6. The cap as claimed in claim 1, wherein the releasable securing means includes a male fastening device and a female fastening device, and the male fastening device is attached on the first extended portion and the female fastening device is attached on the second extended portion.

7. The cap as claimed in claim 6, wherein the first extended portion and the male fastening device are sewn onto a first area adjacent to a lower edge of the opening of the crown.

8. The cap as claimed in claim 7, wherein the second extended portion and the female fastening device are sewn onto a second area adjacent to the lower edge of the opening of the crown.

9. The cap as claimed in claim 8, wherein the first area is opposite to the second area from the opening of the crown.

10. The cap as claimed in claim 6, the male and female fastening devices are made of hook and loop type fastener.

11. The cap as claimed in claim 6, the male fastening device is secured onto an outer surface of the first extended portion and the female fastening device is secured onto an inner surface of the second extended portion, wherein the male and female fastening devices face each other.

12. The cap as claimed in claim 11, wherein the male fastening device and the female fastening device adhere to each other when pressed, depending on a size of the head of a wearer.

13. A baseball cap, comprising:

a crown composed of a plurality of panels, said crown defining an opening on a back portion of said crown;

a visor secured to a front portion of said crown;

a sweatband attached to an inner side of a lower periphery of said crown;

said sweatband being extended at both ends in equal length to that of the opening of the crown to form a first extended sweatband and a second extended sweatband that both extend into the opening; and a male fastening device and a female fastening device respectively attached onto said first extended sweatband and said second extended sweatband.

14. The baseball cap as claimed in claim 13, wherein said sweatband is made out of woven fabric material.

15. The baseball cap as claimed in claim 13, wherein said sweatband is made out of non-woven fabric material.

16. The baseball cap as claimed in claim 13, wherein the first extended sweatband and the male fastening device are sewn onto a first area adjacent to a lower edge of the opening of the crown.

17. The baseball cap as claimed in claim 13, wherein the second extended sweatband and the female fastening device are sewn onto a second area adjacent to the lower edge of the opening of the crown.

18. The baseball cap as claimed in claim 17, wherein the first area is opposite to the second area from the opening of the crown.

19. The baseball cap as claimed in claim 13, the male and female fastening devices are made of hook and loop type fastener.

20. The baseball cap as claimed in claim 13, the male fastening device is secured onto an outer surface of the first extended sweatband and the female fastening device is secured onto an inner surface of the second extended sweatband, wherein the male and female fastening devices face each other.

21. The baseball cap as claimed in claim 20, wherein the male fastening device and the female fastening device adhere to each other when pressed, depending on a size of the head of a wearer.

* * * * *